US007097905B2

(12) United States Patent
Choi et al.

(10) Patent No.: US 7,097,905 B2
(45) Date of Patent: Aug. 29, 2006

(54) MICROCELLULAR FOAMED FIBER, AND A PROCESS OF PREPARING FOR THE SAME

(75) Inventors: Yoeng-Baeg Choi, Daegu-si (KR); Young-Hwan Lee, Kyungsangbuk-do (KR); In-Sik Han, Daegu-si (KR)

(73) Assignee: Kolon Industries, Inc., Kwacheon-city (KR)

( * ) Notice: Subject to any disclaimer, the term of this patent is extended or adjusted under 35 U.S.C. 154(b) by 0 days.

(21) Appl. No.: 10/529,543

(22) PCT Filed: Oct. 17, 2003

(86) PCT No.: PCT/KR03/02170

§ 371 (c)(1),
(2), (4) Date: Mar. 29, 2005

(87) PCT Pub. No.: WO2004/035884

PCT Pub. Date: Apr. 29, 2004

(65) Prior Publication Data

US 2006/0049539 A1 Mar. 9, 2006

(30) Foreign Application Priority Data

Oct. 18, 2002 (KR) ..... 10-2002-0063666
Oct. 18, 2002 (KR) ..... 10-2002-0063667

(51) Int. Cl.
*D01F 6/00* (2006.01)

(52) U.S. Cl. ..... 428/398; 428/376

(58) Field of Classification Search ..... 428/364, 428/398, 376

See application file for complete search history.

(56) References Cited

U.S. PATENT DOCUMENTS

| | | | |
|---|---|---|---|
| 5,512,231 | A | 4/1996 | Thies et al. |
| 5,762,840 | A | 6/1998 | Tsai et al. |
| 5,886,053 | A | 3/1999 | Park et al. |
| 6,051,174 | A | 4/2000 | Park et al. |

*Primary Examiner*—N. Edwards
(74) *Attorney, Agent, or Firm*—Birch, Stewart, Kolasch & Birch, LLP

(57) ABSTRACT

The present invention discloses microcellular fibers, in which microcells are formed with a density of more than $10^7$ cells/cm$^3$ with a supercritical fluid introduced into fiber forming polymers and have a rate of volume expansion of 1.2 to 50, ratio of microcell length to microcell diameter of more than 2 and a monofilament diameter of more than 5 μm. The microcellular fibers provide high and uniform cell densities and are good in the rate of volume expansion and the ratio of cell length to cell diameter, thus they are very excellent in lightweight feeling and touch. The microcellular fibers are made by a method for making microcellular fibers, wherein a supercritical fluid is introduced into an extruder upon melting and mixing fiber forming polymers in the extruder, to thus prepare a single-phase solution of molten polymer and gas, then the single-phase solution of molten polymer and gas is extruded (spun) through spinneret of spinning pack by subjecting the single-phase solution to a rapid pressure drop, to thus make microcellular extrusion materials, the microcellular extrusion materials are rapidly cooled by a cooling medium, and then they are wound at a winding speed of 10 to 6,000 m/min so that a spinning draft can be 2 to 300.

6 Claims, No Drawings

MICROCELLULAR FOAMED FIBER, AND A PROCESS OF PREPARING FOR THE SAME

TECHNICAL FIELD

The present invention relates to microcellular fibers, which have microcells in the fibers and thus are very excellent in lightweight property and touch, and a method for making the same.

More particularly, the present invention relates to microcellular fibers, which are made by introducing a supercritical fluid into an extruder to prepare a single-phase solution of molten polymer and gas, then spinning the single-phase solution to spinneret of spinning pack and then rapidly cooling the same, when continuously extruding and spinning fiber forming polymers, and which provide high and uniform densities of microcells and are good in the rate of volume expansion and the ratio of cell length to cell diameter, and a method for making the same.

BACKGROUND ART

General cellular polymer products have been commonly used industrially for a long time in order to make polymer products lightweight and save the required quantity of polymer. Of them, polystyrene foam products are representative and being used for a wide range of uses.

However, such general cellular polymer products have a cell size of 100 μm or so, so it is difficult to manufacture them into a continuous filament. Besides, they have a very low cell density of $10^6$ cells/cm$^3$, thus they are poor in touch and lightweight property and are difficult to acquire uniform physical properties.

To solve these problems, U.S. Pat. No. 5,866,053 and Pat. No. 6,051,174 disclose a method for making a microcellular extrusion materials in which a supercritical fluid such as $CO_2$ is introduced into an extruder upon mixing and melting polymers in the extruder to prepare a single-phase solution of molten polymers and gas, and then the single-phase solution kept at a high pressure is extruded through a die to form a plurality of microcells by subjecting the single-phase solution to a rapid pressure drop.

The microcellular extrusion materials prepared by the above method is advantageous in that it provides cell sizes of less than 10 μm, which are smaller than the flaws preexisting within the polymers so that there occurs no decrease in the mechanical properties, and it provides high cell densities of $10^9$ cells/cm$^3$ or so, thus, the required amount of polymers can be saved. But, the above method is unsuitable for the manufacture of microcellular fibers since the molten polymer with a plurality of microcells are extruded into the air (at a room temperature) and slowly cooled down.

In other words, particularly, filaments, which are fibers of a continuous state, must undergo the process of making fine the extrusion materials spun from a spinneret through a very big deformation, the above method in which the molten polymer with a plurality of microcells are slowly cooled down after extrusion is unsuitable for a fiber manufacturing process, i.e., a filament spinning process.

Additionally, in case that the molten material prepared by the above method is melted and spun to make filaments for clothing such as polyamide filaments or polyester filaments, the melting strength of the spun filaments is low and thus a gas in the microcells flows out of the polymers immediately after the spinning (extruding), thus it is difficult to manufacture filaments (fibers) for clothing with high microcell densities.

To solve such a problem of an outflow of a gas in microcells, some methods for improving the melting strength of spun filaments by modifying polymers chemically have been attempted. But, in this case, there occurs a new problem such as a decrease of draw ratio in a drawing process, so this makes it difficult to manufacture microcellular fibers.

It is an object of the present invention to provide microcellular fibers for clothing which provide an excellent lightweight feeing and touch with microcells formed at a density of more than $10^7$ cells/cm$^3$.

It is another object of the present invention to effectively prevent the outflow of gas in microcells upon making microcellular fibers. It is another object of the present invention to effectively make microcellular fibers for clothing which provide an excellent lightweight feeling and touch with a plurality of microcells.

DISCLOSURE OF INVENTION

The present invention aims to provide microcellular fibers which provide an excellent lightweight feeling and touch because microcells are uniformly formed with a high density, and provide excellent mechanical properties such as strength because of good rate of volume expansion and good ratio of cell length to cell diameter.

In addition, the present invention aims to effectively manufacture microcellular fibers having microcell densities of $10^7$ cells/cm$^3$ or so by extruding (spinning) a single-phase solution of molten polymer and gas prepared by introducing a supercritical fluid into an extruder. For this, the present invention manufactures microcellular extrusion materials (fibers) by extruding (spinning) the single-phase solution of molten polymer and gas through spinneret of spinning pack by subjecting the single-phase solution to a rapid pressure drop. In addition, the present invention rapidly cools the microcellular extrusion materials (fibers) after the extruding so as to avoid flowing out of the gas from extrusion materials (fibers). In addition, the present invention controls a spinning draft within a proper range so as to properly maintain microcell densities and physical properties upon making microcellular fibers.

To accomplish the above objects, the microcellular fibers of the present invention are characterized in that microcells are formed with a density of more than $10^7$ cells/cm$^3$ with a supercritical fluid introduced into fiber forming polymers and have a rate of volume expansion of 1.2 to 50, a ratio of microcell length to microcell diameter of more than 2 and a monofilament diameter of more than 5 μm.

Meanwhile, the method for making microcellular fibers of the present invention is characterized in that a supercritical fluid is introduced into an extruder upon melting and mixing fiber forming polymers in the extruder, to thus prepare a single-phase solution of molten polymer and gas, then the single-phase solution of molten polymer and gas is extruded (spun) through spinneret of spinning pack by subjecting the single-phase solution to a rapid pressure drop, to thus make microcellular extrusion materials, then the microcellular extrusion materials are rapidly cooled by a cooling medium, and then they are wound at a winding speed of 10 to 6,000 m/min so that a spinning draft can be 2 to 300.

Hereinafter, the present invention will be described in detail.

Firstly, a method for making microcellular fibers according to the present invention will be described in detail. In a typical synthetic fiber spinning process for continuously extruding and spinning a fiber forming polymer, a supercritical fluid is introduced into an extruder upon melting and mixing a fiber forming polymer in the extruder to thus prepare a single-phase solution of molten polymer and gas with a uniform concentration.

The fiber forming polymer includes (i) polyolefin resins such as polypropylene and polyethylene, (ii) polyamide resins such as polyamide 6, polyamide 66 and polyamide with a third component copolymerized or blended, and (iii) polyester resins such as polyethylene terephthalate and polyester with a third component copolymerized or blended.

More preferably, the fiber forming polymer includes polyamide 6 having a relative viscosity of more than 3.0 or polyethylene terephthalate having an inherent viscosity of more than 0.8 both from a viewpoint of steric configuration such as size, density, distribution, etc. of microcells and from a viewpoint of mechanical properties such as strength.

If the relative viscosity of polyamide 6 is less than 3.0 or the inherent viscosity of polyethylene terephthalate is less than 0.8, the cell densities may be lowered to less than $10^7$ cells/$cm^3$ and the cell sizes may be non-uniform.

The fiber forming polymer may include a branched polyamide 6 and a branched polyester resin.

The supercritical fluid includes carbon dioxide ($CO_2$) or nitrogen ($N_2$), more preferably, carbon dioxide ($CO_2$) from a viewpoint of the stability of a manufacturing process.

The introduced amount of the supercritical fluid is preferably less than 10% by weight relative to the fiber forming polymer. The melting amount of the supercritical fluid in the fiber forming polymer is dependent upon the pressure and temperature of an extruder. Specifically, the higher the pressure of the extruder is and the lower the temperature is, the more the melting amount of the supercritical fluid becomes.

Next, the single-phase solution of molten polymers and gas prepared in the extruder is fed to a metering pump and a spinneret, and then extruded (spun) through spinneret of spinning pack while subjecting the single-phase solution to a rapid pressure drop to thus make a microcellular extrusion material. At this time, it is more preferable for the manufacture of fibers for clothing that the spinning pack with at least two spinneret perforated is employed.

It is well known that multifilaments are more suitable for fibers for clothing than monofilaments.

The pressure drop rate in the spinneret of spinning pack is closely related to the densities of microcells, i.e., created cells. It is known that, the more rapid the pressure drop rate is, the higher the cell densities become. To sufficiently exhibit the function of microcellular fibers characterized by lightweight property and form microcells with uniform and small sizes, it is preferable to extrude the single-phase solution into fibrous microcellular extrusion materials having cell densities of more than $10^7$ cells/$cm^3$. If the extrusion materials have cell densities of less than $10^7$ cells/$cm^3$, they are not much improved in lightweight property as compared to hollow fibers and thus are lack of commercial values.

Preferably, the pressure drop rate in the spinneret of the pack is more than 0.18 GPa/s (26,100 psi/s).

Next, the microcellular extrusion materials (fibers) extruded (spun) continuously as above are rapidly cooled by a cooling medium, thereby preventing the gas in the microcells from flowing out.

In a case that the above rapid cooling treatment is not carried out, the gas contained in the microcells move onto the surface until at last it is easily flow out of the fibers. This leads to two bad phenomena of cell coalescence and cell collapse.

Finally, since the cell densities are lowered to less than $10^7$ cells/$cm^3$ and thus are not much improved in lightweight property as compared to hollow fibers, they are lack of commercial values.

The above-described two bad phenomena will be explained in more detail. In case of fiber forming polymers, most of them have a low melting strength around a spinning temperature. Thus, there occurs a phenomenon that, unless they are rapidly cooled within a short time immediately after the extruding, the diffusion velocity of gas becomes higher due to the low melting strength and the gas moves into the air where the pressure is low, that is, onto the surface of the extrusion materials to thus flow out of the surface. This causes a decrease in cell densities by the cell coalescence in which adjacent cells coalesce.

The other phenomenon is that the cell sizes becomes gradually smaller due to the diffusion and outflow of the gas, and, at last, the cell densities become lower by the cell collapse by which cells are eliminated.

These two bad phenomena may be fatal defects that cause non-uniformity in cell shapes and deteriorate the physical properties and cell densities.

As the cooling medium, a cooling air or water is selectively employed according to the kind of a fiber forming polymer being used. In case that cooling at a higher speed is required, it is preferable to use water rather than use a cooling air.

In case of using a cooling air, the cooling air is blasted on a extrusion material obtained immediately after extruding. In case of using water, the water is sprayed on a extrusion material obtained immediately after extruding or the extrusion material is immersed in the water. Preferably, the cooling air is used as the cooling medium in order to increase a spinning speed.

Next, the extrusion materials (fibers) rapidly cooled continuously are wound at a winding speed of 10 to 6,000 m/min so that a spinning draft can be 2 to 300 to thus make microcellular fibers.

The spinning draft is a very important process control factor in a melt-spinning process and represents the ratio of winding speed relative to initial spinning speed. In case that the winding speed is high or the initial spinning speed is low, the spinning draft becomes larger, while, in case that the winding speed is low or the initial spinning speed is high, the spinning draft becomes smaller.

In the present invention, the spinning draft is controlled to 2 to 300. If the spinning draft is more than 300, this generates many yarn cutting due to an excessive spinning draft and thus workability are deteriorated. If the spinning draft is less than 2, oriented crystallization is not sufficiently attained and thus the physical properties such as strength are deteriorated.

Additionally, in the present invention, the winding speed is controlled to 10 to 6,000 m/min, more preferably, to 50 to 6,000 m/min. The winding speed is flexibly controlled depending on the density, size and distribution of microcells. In case that the densities of the microcells are very high and the sizes thereof are relatively large, it is difficult to increase the winding speed. But, if the winding speed is less than 10 m/min, the commercial availability is lacking.

Meanwhile, in case that the densities of microcells are very low and the sizes thereof are relatively small and they are uniformly distributed, the winding speed can be increase up to 6,000 m/min. But, if the winding sped is more than 6,000 m/min, the workability is lowered.

The microcellular fibers of the present invention made by the above mentioned method have microcells uniformly formed at a density of more than $10^7$ cells/cm$^3$. Thus, they are excellent in lightweight property and touch and there is no problem of the deterioration of physical properties such as strength caused by the microcells.

Additionally, the microcellular fibers of the present invention has a rate of volume expansion of 1.2 to 50, a ratio of microcell length to microcell diameter is more than 2, and the diameter of monofilaments is more than 5 μm.

If the rate of volume expansion is less than 1.2, only the lightweight property no more than that of hollow fibers with a 20% hollowness is obtained and thus this provides no practicality. If the rate of volume expansion is more than 50, this causes a decrease in strength due to an excessive volume expansion and the workability is lowered, thus disabling a yarn production.

Moreover, if the ratio of microcell length to microcell diameter is less than 2, this generates a problem that a minimum strength required for yarns for clothing can not be satisfied.

The fact that the above-mentioned ratio of length to diameter is more than 2 has almost the same meaning as the fact that the fibers are drawn more than two times.

That is, the microcells generated at the first have a spherical shape or a honeycomb shape and the ratio of microcell length to microcell diameter is almost near 1. But, the higher the winding speed becomes, the microcells are deformed into ones having such a shape to be elongated in the fiber axial direction. When the subsequent drawing process is followed, the microcells are much more deformed in the axial direction.

As the result, constituent polymers are oriented and are subsequently crystallized, and the mechanical properties such as strength are improved. Therefore, the ratio of microcell length to microcell diameter has to be more than 2 in order to exhibit the minimum strength of microcellular fibers. If the above condition is not satisfied, it is made difficult to adapt microcellular fibers for final uses such as clothing.

Additionally, if the diameter of monofilaments is less than 5 μm, this monofilament diameter is not sufficient relative to the average diameter of the microcells with a 1 μm or so, thereby making it difficult to stably form a structure of microcellular fibers.

The microcellular fibers made by the method of this invention have a large quantity of uniform microcells distributed uniformly, thus they are very superior in lightweight property and touch. As the result, they are very useful for fibers for clothing such as innerwear and outerwear.

Various physical properties in the present invention were each evaluated by the following methods.

Rate of Volume Expansion (Φ)

The volume ($V_P$) of polymers, the weight of polymers ($m_P$), the specific gravity ($P_P$) of polymers and the volume ($V_f$) of microcellular fibers are measured, and then the measured values are substituted into the following formula to calculate the volume expansivity.

$$\text{Rate of volume expansion}(\Phi) = \frac{V_f}{V_p} = \frac{V_f}{M_p \times P_p}$$

Microcell Density (cells/cm$^3$)

The cross sections of microcellular fibers are observed by a scanning electron microscope, and the result is substituted into the following formula to calculate the cell density (ρc)

$$\text{Microcell Density } (\rho c) = (nl \times 10\ \mu m/l)^{3/2} \times 10^9 \times \text{volume expansion coefficient,}$$

wherein nl is a number of microcells existing in a square of which one side is 1 cm as the result of observation by the scanning electron microscope.

Ratio of Microcell Length to Microcell Diameter

The cross sections of microcellular fibers and the lengths thereof in a direction perpendicular to the cross sections are measured to obtain their ratio.

Lightweight Property and Touch

The lightweight property and the touch are evaluated by an organoleptic panel test. In detail, if 8 persons out of 10 panelists judge the lightweight property and the touch excellent, this is represented as , and if 7 persons out of 10 panelists judge the lightweight property and the touch excellent, this is represented as Δ.

BEST MODES FOR CARRYING OUT THE INVENTION

Hereinafter, the present invention will be described in more detail with reference to examples and a comparative example. But, the present invention is not limited to the following examples.

EXAMPLE 1

A polyamide 6 resin having a relative viscosity of 3.4 is melted and mixed in an extruder with a 250° C. temperature by a static mixer and at the same time a 3% carbon dioxide by weight (relative to the weight of resin) is introduced into the extruder to prepare a single-phase solution of liquid polymer and gas having a uniform concentration. Continuously, the single-phase solution of liquid polymer and gas is extruded through a spinneret having a 0.25 mm diameter and a 2.5 mm length of spinning pack (with five spinneret) at a extrusion amount of 10 g/min to make fibrous microcellular discharge materials by subjecting the single-phase solution to a rapid pressure drop rate. Continuously, water of 25° C. is sprayed onto the fibrous microcellular extrusion materials from the position 1 cm below from the bottom surface of the spinning pack to rapidly cool the extrusion materials. Then, the extrusion materials are wound at a winding speed of 500 m/min so that the spinning draft can be 12 to manufacture microcellular fibers. The results of evaluation of various physical properties of the manufactured microcellular fibers are as shown in Table 2.

EXAMPLES 2 TO 10 AND COMPARATIVE EXAMPLE 1

Microcellular fibers are manufactured in the same process and under the same condition as Example 1 except that the kind of a cooling medium, a rapid cooling method, a spinning draft, a winding speed, the kind of fiber forming polymers, a spinning temperature, the kind of gas and the introduced amount of gas are changed as in Table 1. The result of evaluation of various physical properties of the manufactured microcellular fibers are as stated in Table 2.

TABLE 1

Manufacturing Conditions

| Classification | kind of fiber forming polymer (relative viscosity) | Spinning temperature (° C.) | Kind of gas | Introduced amount of gas (% by weight) | Kind of cooling medium | Cooling temperature (° C.) | Cooling method (wind velocity) | Spinning draft | Winding speed (m/min) |
|---|---|---|---|---|---|---|---|---|---|
| Example 1 | Polyamide 6 (3.4) | 250 | Carbon dioxide | 3 | water | 25 | Spraying method | 12 | 500 |
| Example 2 | Polyethylene terephthalate (1.1)* | 285 | air | 2.5 | water | 25 | Spraying method | 12 | 500 |
| Example 3 | Polyamide 6 (3.5) | 250 | Carbon dioxide | 3 | water | 25 | Spraying method | 24 | 1,000 |
| Example 4 | Polyamide 6 (3.5) | 250 | Carbon dioxide | 3 | water | 25 | Spraying method | 37 | 1,500 |
| Example 5 | Polyamide 6 (3.5) | 250 | Carbon dioxide | 3 | water | 25 | Immersion method | 2.5 | 100 |
| Example 6 | Polyamide 6 (3.5) | 250 | Carbon dioxide | 3 | water | 25 | Immersion method | 5 | 200 |
| Example 7 | Polyamide 6 (3.5) | 250 | Carbon dioxide | 3 | Cooling air | 14 | Blasting method (1 m/sec) | 49 | 2,000 |
| Example 8 | Polyamide 6 (3.5) | 250 | Carbon dioxide | 3 | Cooling air | 14 | Blasting method (1 m/sec) | 74 | 3,000 |
| Example 9 | Polyamide 6 (3.5) | 250 | Carbon dioxide | 3 | Cooling air | 14 | Blasting method (1 m/sec) | 123 | 5,000 |
| Example 10 | Polyamide 6 (3.5) | 250 | Carbon dioxide | 3 | Water | 25 | Spraying method | 24 | 1,000 |
| Comparative example 1 | Polyamide 6 (3.5) | 250 | Carbon dioxide | 3 | none | — | Natural cooling with room temperature | 24 | 1,000 |

※ Polyethylene terephthalate
(1.1)* of example 2 means polyethylene terephthalate with inherent viscosity of 1.1.

TABLE 2

The results of evaluation

| classification | Microcell density (cells/cm$^3$) | Volume exapansivity | Ratio of microcell length to micorcell diameter | Spinning stability (full winding rate) | Lightweight feeing | touch |
|---|---|---|---|---|---|---|
| Example 1 | $3 \times 10^9$ | 3.2 | 4.3 | 93% | ◎ | ◎ |
| Example 2 | $2 \times 10^9$ | 2.8 | 3.7 | 94% | ◎ | ◎ |
| Example 3 | $2 \times 10^9$ | 2.9 | 3.5 | 96% | ◎ | ◎ |
| Example 4 | $2 \times 10^9$ | 2.7 | 3.9 | 95% | ◎ | ◎ |
| Example 5 | $5 \times 10^9$ | 3.5 | 4.1 | 82% | ◎ | ◎ |
| Example 6 | $4 \times 10^9$ | 3.3 | 4.5 | 92% | ◎ | ◎ |
| Example 7 | $8 \times 10^8$ | 3.1 | 3.7 | 96% | ◎ | ◎ |
| Example 8 | $6 \times 10^8$ | 2.8 | 3.9 | 94% | ◎ | ◎ |
| Example 9 | $5 \times 10^8$ | 3.0 | 4.2 | 95% | ◎ | ◎ |
| Example 10 | $8 \times 10^8$ | 4.9 | 5.3 | 94% | ◎ | ◎ |
| Comparative example 1 | — | — | — | Unwindable | — | — |

※ Comparative Example 1 was unwindable, so it was impossible to evlaute cell density, volume expansivity, ratio of cell length to cell diameter, lightweight feeling and touch.

INDUSTRIAL APPLICABILITY

The microcellular fibers of this invention have microcells uniformly formed with a high density and thus are excellent in lightweight property and touch and have no decrease in mechanical properties caused by the microcells. Moreover, the microcellular fibers of this invention are good in the rate of volume expansion and the ratio of microcell length to microcell diameter, thus they provide excellent mechanical properties such as strength and are improved in yarn producing properties.

Furthermore, the present invention can continuously manufacture microcellular fibers having microcell densities of more than $10^7$ cells/cm$^3$ by using a single-phase solution of molten polymer and gas prepared by introducing a supercritical fluid into an extruder. In addition, the present invention can effectively prevent the outflow of gas in extrusion materials (fibers) to thus increase the densities of microcells in the fibers.

The microcellular fibers of the present invention are excellent in lightweight property and touch and are particularly useful as yarns for clothing.

The invention claimed is:

1. Microcellular fibers, characterized in that microcells are formed with a density of more than $10^7$ cells/$cm^3$ with a supercritical fluid introduced into fiber forming polymers and have a rate of volume expansion of 1.2 to 50, a ratio of microcell length to microcell diameter of more than 2 and a monofilament diameter of more than 5 μm.

2. The microcellular fibers of claim 1, wherein the supercritical fluid is one of carbon dioxide ($CO_2$) or nitrogen ($N_2$).

3. The microcellular fibers of claim 1, wherein the fiber forming polymers include polyamide resins, polyester resins, branched polyester resins or polypropylene resins.

4. The microcellular fibers of claim 1 or 3, wherein the fiber forming polymers are polyamide 6 having a relative viscosity of more than 3.0.

5. The microcellular fibers of claim 1 or 3, wherein the fiber forming polymers are polyethylene terephthalate having an inherent viscosity of more than 0.8.

6. The microcellular fibers of claim 1 or 3, wherein the fiber forming polymers are branched polyamide 6.

* * * * *